US009943854B1

(12) United States Patent
Melnyk et al.

(10) Patent No.: US 9,943,854 B1
(45) Date of Patent: Apr. 17, 2018

(54) CRYOMILL SYSTEM

(71) Applicants: Christoperh T. Melnyk, Calgary (CN); Brian K. Weinstein, Los Angeles, CA (US); Robert V. Gansert, Simi Valley, CA (US)

(72) Inventors: Christoperh T. Melnyk, Calgary (CN); Brian K. Weinstein, Los Angeles, CA (US); Robert V. Gansert, Simi Valley, CA (US)

( * ) Notice: Subject to any disclaimer, the term of this patent is extended or adjusted under 35 U.S.C. 154(b) by 250 days.

(21) Appl. No.: 14/751,897

(22) Filed: Jun. 26, 2015

(51) Int. Cl.
*B02C 17/00* (2006.01)
*B02C 17/18* (2006.01)
*F25D 3/11* (2006.01)

(52) U.S. Cl.
CPC ..... *B02C 17/1815* (2013.01); *B02C 17/183* (2013.01); *F25D 3/11* (2013.01)

(58) Field of Classification Search
CPC ..... B02C 17/1815; B02C 17/183; F25D 3/11
USPC ..... 241/65, DIG. 37
See application file for complete search history.

(56) References Cited

U.S. PATENT DOCUMENTS 2,609,150 A 9/1952 Bludeau
2,735,624 A 2/1956 Beck
2,919,862 A 1/1960 Beike et al.
3,273,294 A 9/1966 Trzesniewski
3,614,001 A 10/1971 Beike
3,771,729 A 11/1973 Frable
4,222,527 A * 9/1980 Davis ..... A23G 1/047 241/33
4,273,294 A * 6/1981 Hollely ..... B02C 19/186 241/18
4,428,535 A * 1/1984 Venetucci ..... B01F 7/088 241/186.5
5,775,603 A * 7/1998 Kohler ..... B02C 13/288 241/23
6,076,752 A * 6/2000 Paradowski ..... B02C 19/186 241/16
6,311,904 B1 * 11/2001 Leturmy ..... B02C 19/0081 241/18
7,258,288 B2 * 8/2007 Waznys ..... B02C 19/186 241/23
9,566,586 B1 * 2/2017 Manis ..... B03B 5/36
2007/0034722 A1 * 2/2007 Waznys ..... A23L 33/11 241/23
2011/0049275 A1 * 3/2011 Zickell ..... E01C 19/05 241/24.12
2012/0267459 A1 * 10/2012 Beirakh ..... B02C 7/06 241/27

* cited by examiner

*Primary Examiner* — Faye Francis
(74) *Attorney, Agent, or Firm* — Edward P. Dutkiewicz

(57) ABSTRACT

A cryomill system having an intake component housing an auger, a cooling source containing a liquid coolant being coupled to the cryomill system, a cryomill containment portion, having a mixer located therein and an associated cryomill lid coupled thereto, as well as a collection canister having a poppet valve aperture there through and a gas shielded poppet valve coupling the collection canister to the containment portion.

15 Claims, 8 Drawing Sheets

FIG. 2
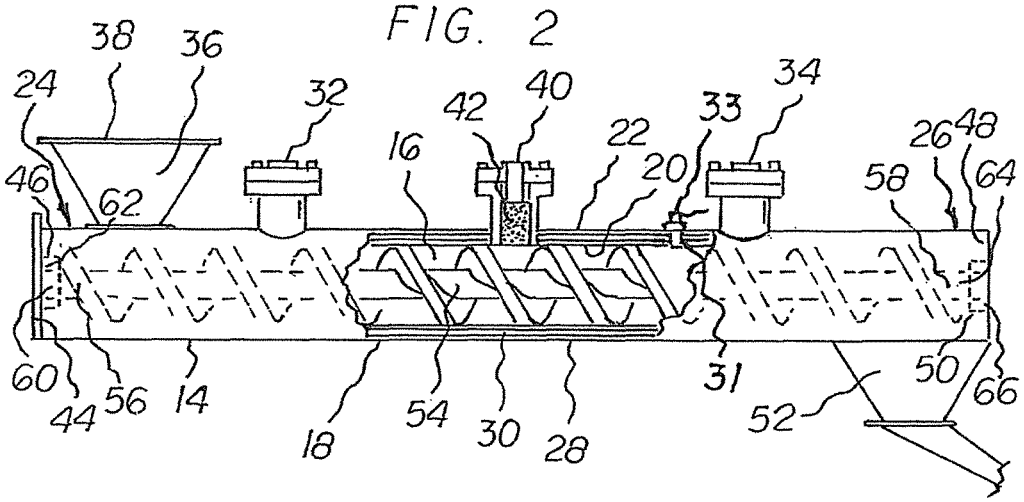
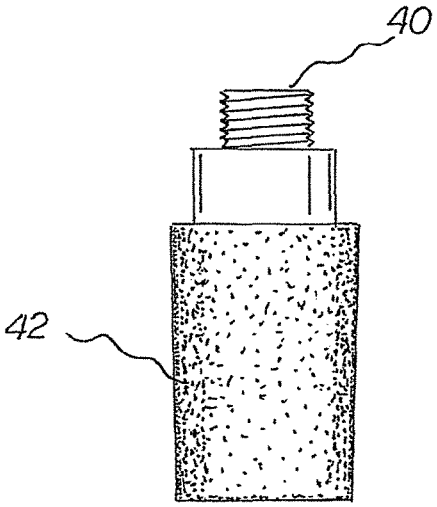
FIG. 3

FIG. 10
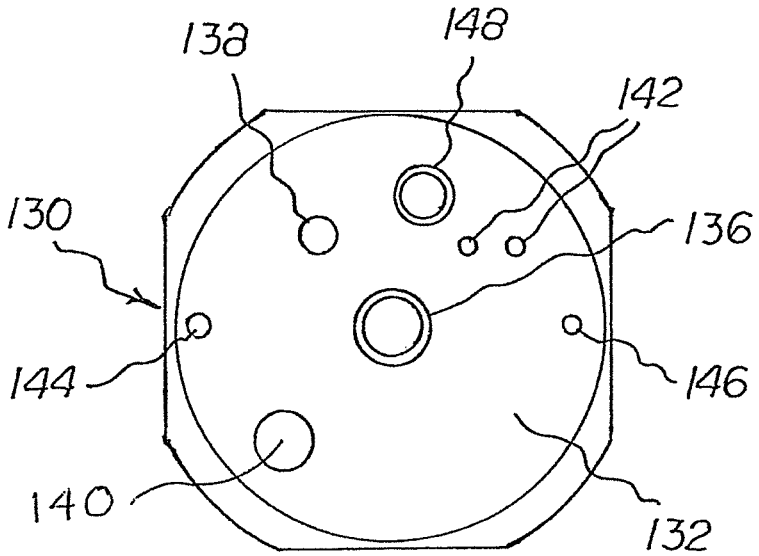
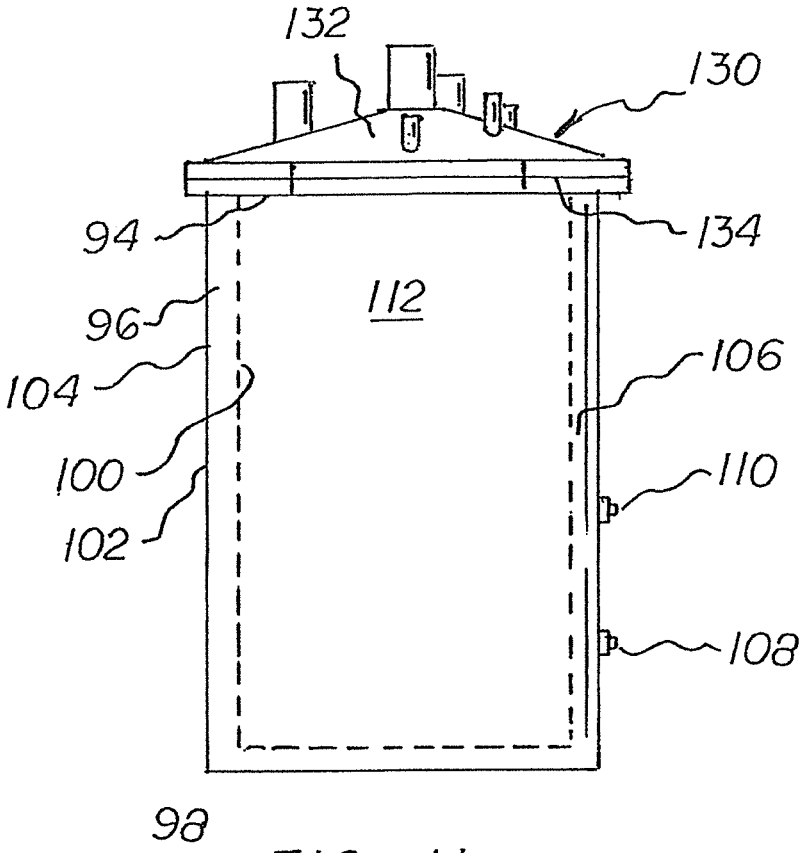
FIG. 11

FIG. 12
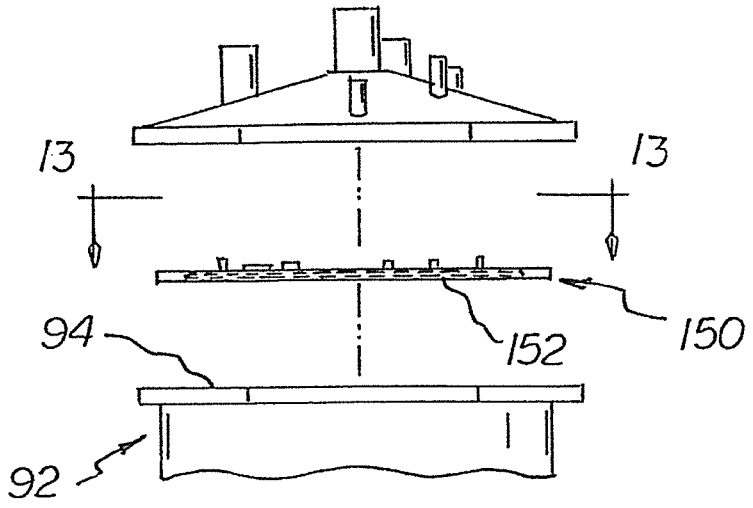
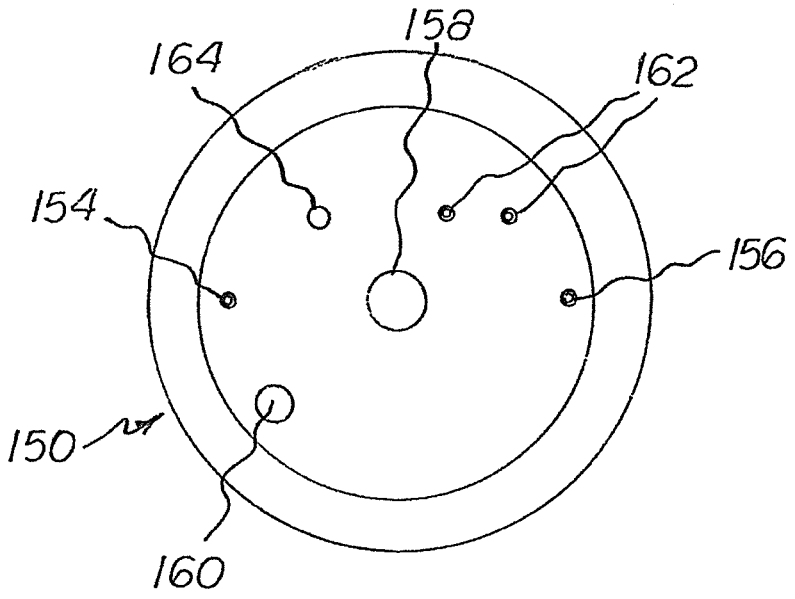
FIG. 13

CRYOMILL SYSTEM

BACKGROUND OF THE INVENTION

Rule 1.78(F) (1) Disclosure

The Applicant has not submitted a related pending or patented non-provisional application within two months of the filing date of this present application. All inventor's names have been disclosed. This application is not under assignment to any other person or entity at this time.

FIELD OF THE INVENTION

The present invention relates to a cryomill system and more particularly pertains to a system for the safe and efficient method of cryomilling flammable materials on an industrial scale.

DESCRIPTION OF THE PRIOR ART

The use of a device to cryomill substances is known in the prior art. More specifically, devices used to cryomill substances, previously devised and utilized for the purpose of reducing materials to a nanocrystalline structure, are known to consist basically of familiar, expected, and obvious structural configurations, notwithstanding the designs encompassed by the prior art which has been developed for the fulfillment of countless objectives and requirements. In that such cryogenic milling of metallic nano-materials is primarily done as research, the methods and components used are inefficient and costly. Moreover, cryogenic milling avoids flammable substances, such as aluminum and titanium, because the system now used incur the risk of combustion and explosion in the surrounding areas. The system herein described contains safety features which reduce any risk of combustion and/or explosion in the surrounding areas.

While the prior art devices fulfill their respective, particular objectives and requirements, the prior art does not describe cryomill system that allows a safe and efficient method of cryomilling flammable materials on an industrial scale.

In this respect, the cryomill system according to the present invention substantially departs from the conventional concepts and designs of the prior art, and in doing so provides an apparatus primarily developed for the purpose of a safe and efficient method of cryomilling flammable materials.

Therefore, it can be appreciated that there exists a continuing need for a new and improved cryomill system which can be used for safe and efficient cryomilling of flammable materials. In this regard, the present invention substantially fulfills this need.

SUMMARY OF THE INVENTION

In view of the foregoing disadvantages inherent in the known types devices used to cryomill substances now present in the prior art, the present invention provides an improved cryomill system. As such, the general purpose of the present invention, which will be described subsequently in greater detail, is to provide a new and improved cryomill system which has all the advantages of the prior art and none of the disadvantages.

In describing this invention, the word "coupled" is used. By "coupled" is meant that the article or structure referred to is joined, either directly, or indirectly, to another article or structure. By "indirectly joined" is meant that there is an intervening article or structure imposed between the two articles which are "coupled". "Directly joined" means that the two articles or structures are in contact with one another or are essentially continuous with one another. The term "coupled" includes the phrase "indirectly joined" and "directly joined".

To attain the goals and objectives of the herein described cryomill system, the present invention essentially comprises several components, in combination.

There is an intake component. The intake component comprises a round hollow tube configuration having an interior passageway and a wall. The tube wall of the intake component has an interior surface and an exterior surface. The round hollow tube of the intake component has a first feed end and a second output end, with a mid-section there between. The round hollow tube has a cooling jacket located between the interior surface of the tube wall and the interior passageway of the tube.

The cooling jacket surrounds the interior passageway of the tube. The cooling jacket has a liquid coolant inflow and a coolant liquid and vapor outflow. The feed end of the tube has an inflow funnel and an inflow funnel passageway. The inflow funnel passageway connects the inflow funnel with the interior of the tube.

The mid-section of the intake component tube has a cryogen inflow passageway, which communicates with the hollow interior passageway of the tube. The cryogen inflow has a metal dispersion element. The first feed end of the tube has a first end plug with a first bearing seat. The second output end of the tube has a second end plug with a second bearing seat. The second output end of the intake component tube has an output funnel.

There is an auger. The auger has a first feed end and a second output end. The first feed end of the auger has a first shaft with an associated first bearing. The second output end of the auger has a shaft with an associated second bearing. The auger is located within the interior passageway of the hollow tube. The first feed end first bearing is received by and mated with the first bearing seat of the first end plug of the intake component. The second output end second bearing is received by and mated with the second bearing seat of the second end plug. The auger has an associated drive motor which rotates the auger within the intake component.

There is a cooling source. The cooling source comprises a liquid coolant. The cooling source has an associated coolant pathway. The coolant pathway has a generally round tubular hollow configuration. The coolant pathway connects the coolant source to the cryomill system, thereby transferring liquid coolant from the cooling source to the cryomill system.

The cooling source is operationally coupled by the coolant pathway to the intake component. The coolant pathway has a tank source line. The tank source line divides into a main phase separator inflow line, having an inline valve, and a jacketing coolant reservoir inflow line, having an inline valve. A second phase separator line is coupled to a main phase separator for the cryomill.

The phase separator has an outflow line. The phase separator outflow line divides into an intake component coolant line and a cryomill coolant line. The intake component coolant line is coupled to the intake component, and the cryomill coolant line is coupled to the lid of the cryomill. The jacketing coolant reservoir inflow line couples the cooling source to the cryomill jacketing coolant reservoir.

There is a cryomill containment portion. The cryomill containment portion comprises an open top, a wall, and a base. The cryomill containment portion wall has an interior surface and an exterior surface, with a wall thickness there between. The wall thickness has coolant passageways therein, for allowing the passage of coolant within the thickness of the containment portion wall. The coolant passageways of the containment portion wall have an inflow pipe and an outflow pipe. The wall thickness also contains a vacuum segment therein located between the exterior surface and the coolant passageways. The interior surface of the cryomill containment portion forms a containment portion interior.

The interior of the cryomill containment portion has an associated mixer. The mixer has a central vertical shaft and a plurality of horizontally extensions. The mixer has an upper drive end and a lower free terminal end.

The cryomill containment portion base has a centrally located outflow aperture. The cryomill containment portion wall has a coolant liquid inflow and a coolant, liquid and vapor outflow. The upper drive end of the mixer is operatively coupled to a mixer drive motor.

There is a cryomill lid. The cryomill lid has an upper, outer surface and lower, inner surface. The lid has a centrally located shaft aperture there through. The lid has a coolant inflow stub there through. The lid has a material inflow stub there through. The lid has a pair of thermocouple insert ports there through. The lid has a condensing plate inflow stub there through. The lid has a condensing plate outflow stub there through. The material inflow of the lid is operatively coupled to the output funnel of the second output end of the intake component tube. The cryomill lid coolant inflow stub is coupled to the cryomill coolant line of the coolant pathway. The lid has an exhaust port there through.

There is a cryomill lid condensing plate. The cryomill condensing plate has a generally hollow configuration, forming a fluid passageway therein. The condensing plate has an inflow end stub being continuous with the condensing plate passageway. The condensing plate has an outflow end stub being continuous with the condensing plate passageway. The condensing plate has a centrally located shaft aperture there through. The condensing plate has a pair of thermocouple insert stubs forming apertures through the condensing plate. The condensing plate has a coolant inflow stub forming an aperture through the condensing plate. The condensing plate is located between the lid of the cryomill and the cryomill containment portion. The condensing plate is located in the free space in the containment portion (mill bowl) in front of the exhaust port. The condensing plate is mounted to, and suspended from, the lid.

There is a collection canister. The collection canister is located vertically beneath the cryomill containment portion. In other variations, the collection canister may be located diagonally from the cryomill, forming a down slope.

The collection canister has a lid and a containment portion. The collection canister containment portion has an open top, a side wall, and a base. The lid of the collection canister has a poppet valve aperture there through.

There is a gas shielded poppet valve subassembly. The gas shielded poppet valve subassembly has a lower end comprising a body, and an upper end comprising a valve seat. The upper end of the gas shielded poppet valve subassembly being operatively coupled to the base of the cryomill. The valve seat of the gas shielded poppet valve subassembly has a flange. The valve seat has an inner retention ring. The valve seat has a pair of threaded control bolt apertures therein. The valve seat flange has a plurality of mounting bolt holes there through.

The poppet valve body is located below the valve seat, when the gas shielded poppet valve subassembly is in an operational position. The valve body has four set screw apertures there through. The valve body has a pair of sloped slots there through.

The valve stem has a valve end and a control end, with a poppet being operatively coupled to the valve end of the valve stem. The valve stem is coupled to the valve body with a plurality of coupling bolts.

The valve seat is coupled to the valve body by a pair of control bolts. The control bolts pass through the sloped slots of the valve body and are each threadedly received by the control bolt threaded holes in the valve seat. The control bolts allow the valve body to be rotated relative to the valve seat, thereby allowing the poppet valve to be in one of the group of orientations, the group of orientations including an open orientation and a closed orientation.

There is a milling jacket coolant reservoir. The milling jacket coolant reservoir has a generally hollow cylindrical configuration with a top, a bottom, and a sidewall there between. The milling jacket coolant reservoir side wall has an exterior surface and an interior surface, with the interior surface forming an interior of the mill jacket coolant reservoir.

The mill jacket coolant reservoir has an inflow and an outflow. The exterior of the side wall of the mill jacket coolant reservoir has a cooling coil associated located therein. The cooling coil has an inflow end and an outflow end. In the preferred embodiment, the inflow end of the cooling coil is coupled to the exhaust port of the jacket coolant reservoir. In other variations, the inflow end of the cooling coil may be coupled to the coolant pathway, so that the main coolant, liquid nitrogen, is provided to the coil from the coolant storage tank. The outflow end of the cooling coil is operatively coupled to a coolant scavenging system.

The inflow of the milling jacket coolant reservoir is operatively coupled to the outflow of the containment portion of the cryomill. The outflow of the milling jacket coolant reservoir is operatively coupled to the scavenging system. In another variation, the outflow of the milling jacket coolant reservoir may be coupled to the inflow of the containment portion of the cryomill. The cooling coil acts to reduce the heat soaked in from the atmosphere into the jacketing coolant reservoir. The cooling coil is fed from the exhaust boil off from the jacket coolant reservoir.

There is electrical power source with an electronic control. The electrical power source with the electronic control is operatively coupled to the valves of the coolant pathway. The electrical power is operatively coupled to, and controls, the auger drive motor. The electrical power is operatively coupled to, and controls, the mixer drive motor. The electrical power is coupled to each of the valves, for controlling the flow of coolant through the system.

Lastly, there is a coolant scavenging subsystem. The coolant scavenging subsystem has an intake and storage tank. The coolant scavenging subsystem intake is coupled to the outflow end of the mill jacket coolant reservoir and the exhaust outflow of the mill containment portion. The coolant scavenging subsystem outflow feeds back into the cryomilling system, providing a recycling of cryogen which is not fully condensed in the milling containment portion via the condenser plate cooling.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved cryomill system which has all of the advantages of the prior art and none of the disadvantages.

It is a further object of the present invention to provide a new and improved cryomill system which is of durable and reliable constructions. It is another further object of the present invention to provide a system and a method of cryogenically milling powders with invented hardware and methodology allowing industrial scale cryomilling with minimal gross liquid nitrogen consumption which otherwise would be very difficult to logistically deliver to the milling site.

An even further object of the present invention is to provide a new and improved cryomill system which is susceptible of a low cost of manufacture with regard to both materials and labor, and which accordingly is then susceptible of low prices of sale to the consuming public, thereby making such cryomill system economically available to the buying public.

Even still another object of the present invention is to provide a cryomill system which provides a safe and efficient method of cryomilling flammable and combustible materials on an industrial scale.

Lastly, it is an object of the present invention to provide a new and improved cryomill system comprising several components, in combination. There is an intake component housing an auger. There is a cooling source containing a liquid coolant being coupled to the cryomill system. There is a cryomill containment portion, having a mixer located therein and an associated cryomill lid coupled thereto. There is a collection canister mating with a poppet valve aperture there through. There is a gas shielded poppet valve coupling the collection canister to the containment portion. There is a in-situ condenser system including a cold plate within the cryomill containment portion. Lastly, there is a scavenging coolant reclaim system.

It should be understood that while the above-stated objects are goals which are sought to be achieved, such objects should not be construed as limiting or diminishing the scope of the claims herein made.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a side elevational view of the intake component, which shows, in phantom, internal structures.

FIG. 3 is a close up view of the metal dispersion element.

FIG. 10 is a top plan view of the containment portion lid.

FIG. 11 is a side elevational view of the containment portion with the lid in place. The interior of the containment portion is shown in phantom.

FIG. 12 is a side elevational view of the containment portion, containment portion lid, and condensing plate, which is located within the containment portion, between the containment portion and the containment portion lid.

FIG. 13 is a view taken along line 13-13 of FIG. 12, showing the jacketing coolant reservoir plate of the containment portion.

The same reference numerals refer to the same parts throughout the various Figures.

DESCRIPTION OF THE PREFERRED EMBODIMENT

Figure 1:
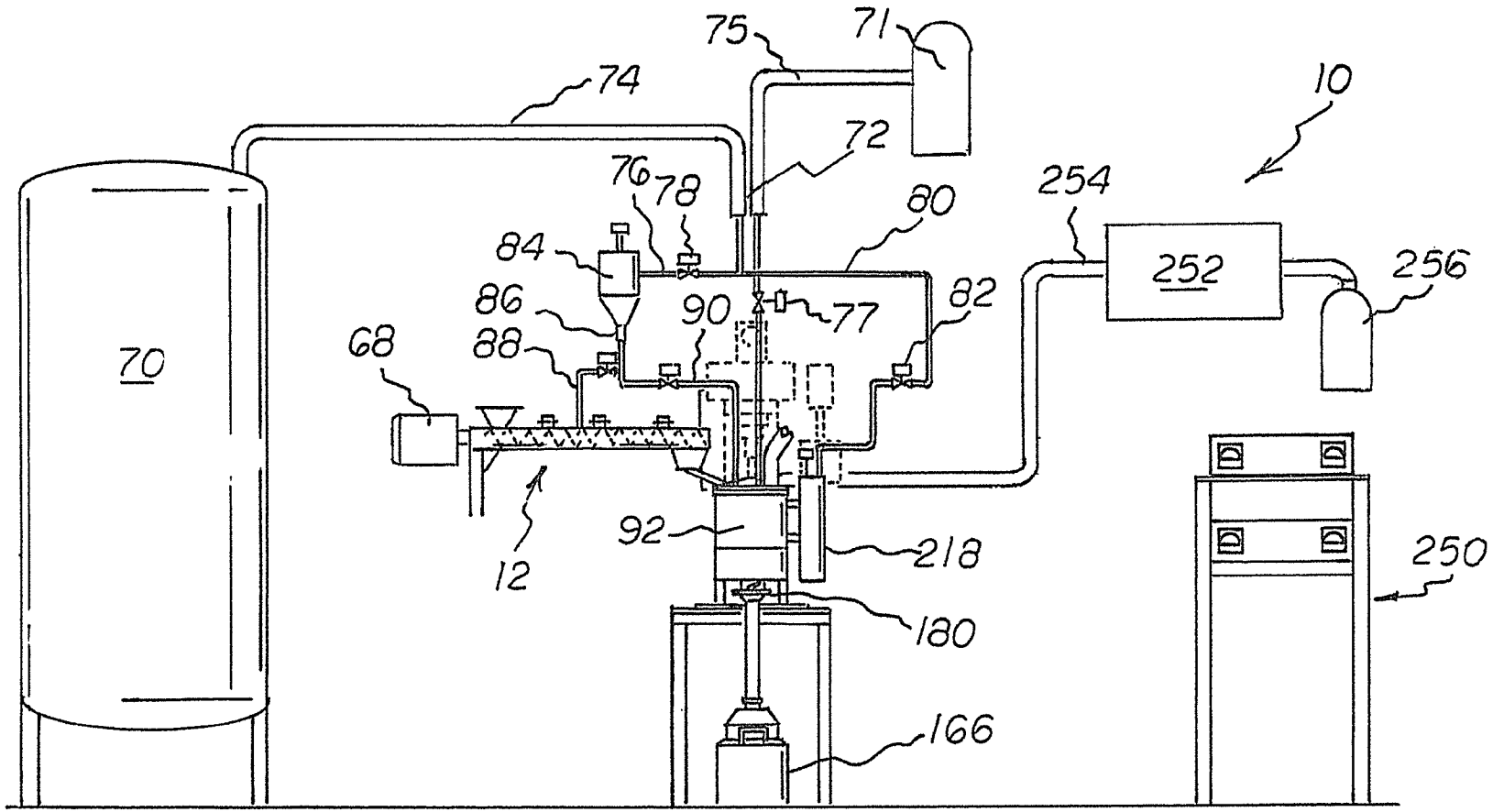
FIG. 1 is side elevational view of the overall system.
Figure 4:
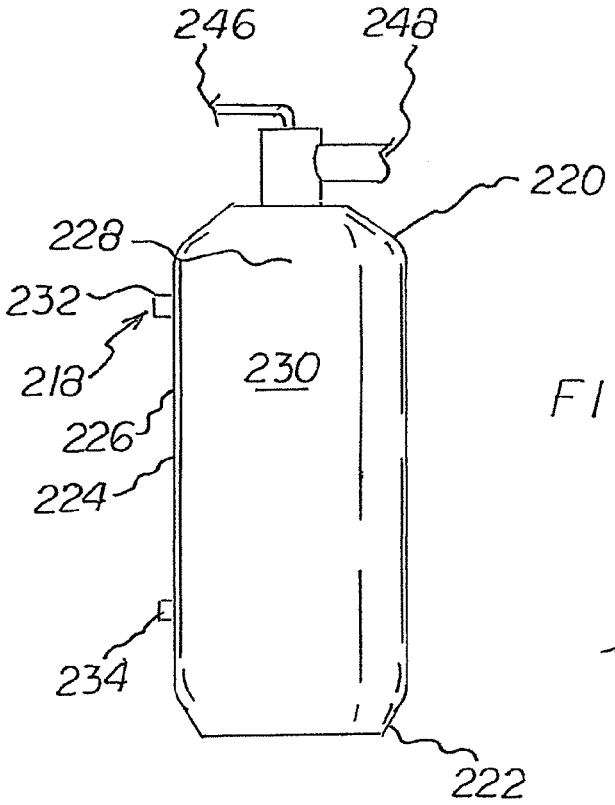
FIG. 4 is side elevational view of a milling jacket coolant reservoir.
Figure 5:
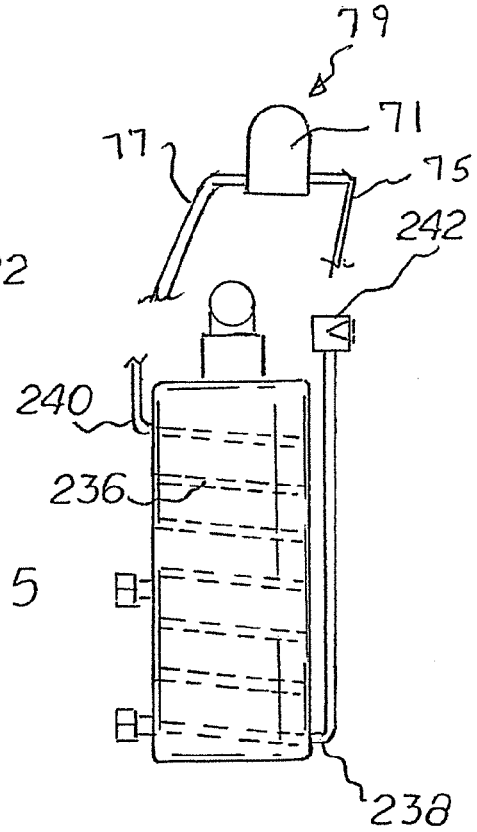
FIG. 5 is side elevational view of a milling jacket coolant reservoir with a cooling coil shown in phantom. The drawing shows the configuration with a second coolant being used in a closed system. If a single coolant is used the inflow of the coil may be coupled to the outflow of the containment portion or, in the alternative, to the coolant source. The outflow of the cooling coil would then be coupled to the coolant scavenging system.
Figure 6:
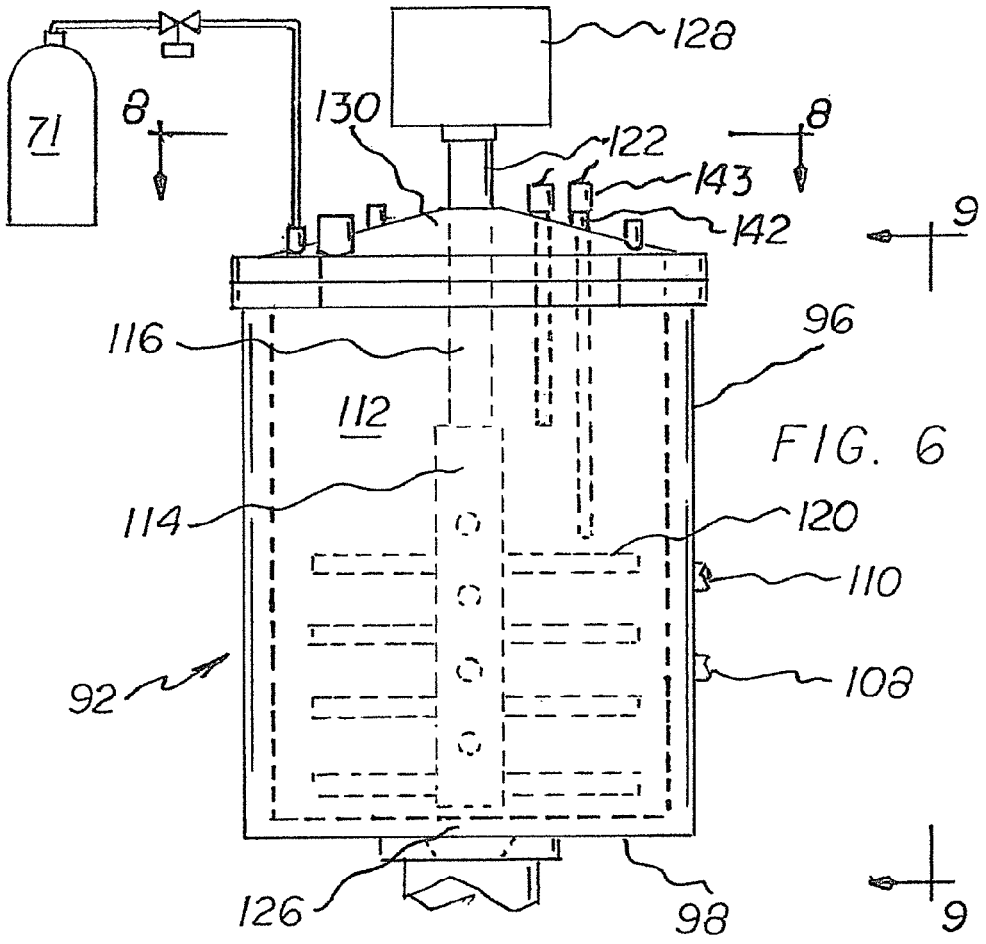
FIG. 6 is side elevational view of the containment portion, showing the mixer in phantom.
Figure 7:
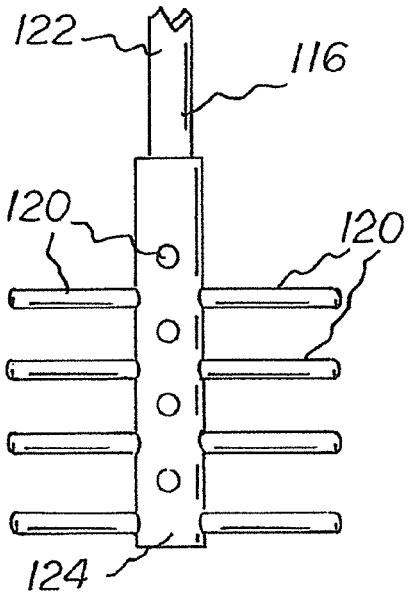
FIG. 7 is side elevational view of the mixer.
Figure 8:
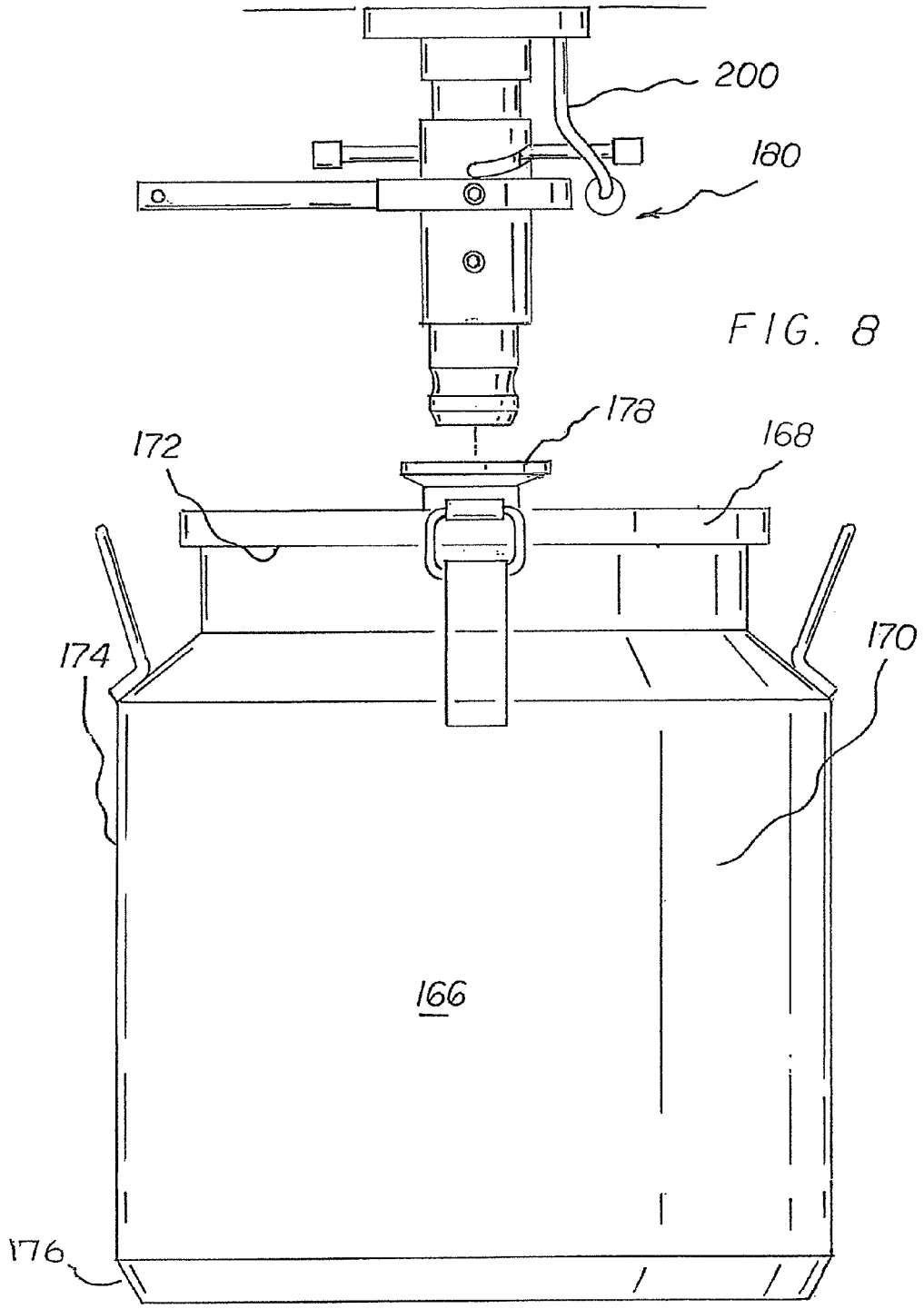
FIG. 8 is side elevational view of the collection canister and gas shielded poppet valve.
Figure 9:
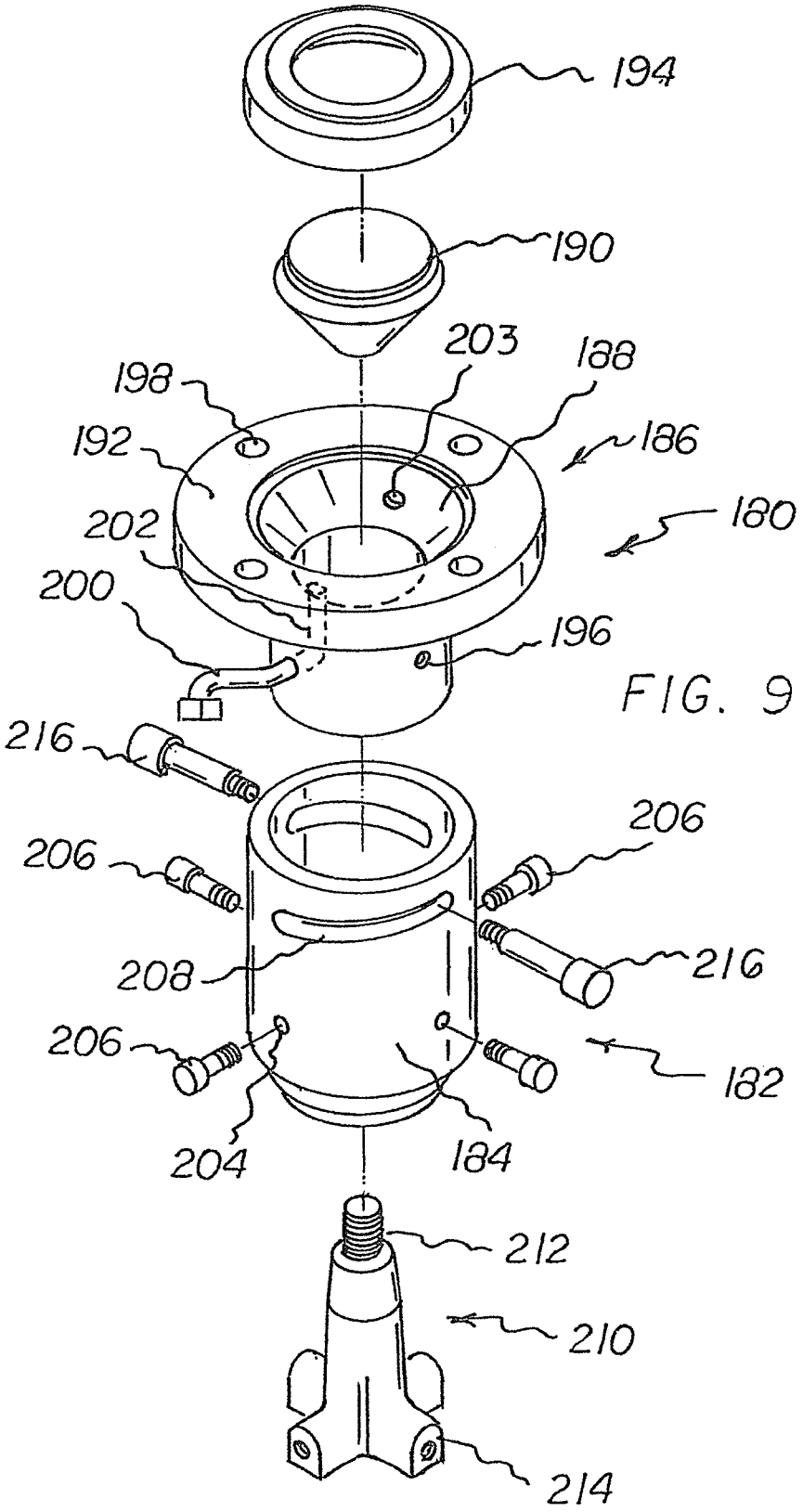
FIG. 9 is an exploded perspective view of the gas shielded poppet valve.

With reference now to the drawings, and in particular to FIG. 1 thereof, the preferred embodiment of the new and improved cryomill system, embodying the principles and concepts of the present invention and generally designated by the reference numeral 10, will be herein described.

The present invention, the cryomill system 10 is comprised of a plurality of components. Such components in their broadest context include a coolant source, an intake component, a cryomill, an in-situ condenser system, a collection canister with a gas shielded valve and coolant scavenging system with liquid cryogen return. Such components are individually configured and correlated with respect to each other so as to attain the desired objective.

A cryomill system 10 comprising several components, in combination, is herein described.

There is an intake component 12. The intake component comprises a round hollow tube configuration 14 having an interior passageway 16 and a wall 18. The tube wall of the intake component has an interior surface 20 and an exterior surface 22. The round hollow tube of the intake component has a first feed end 24 and a second output end 26, with a mid-section 28 there between. The round hollow tube has a cooling jacket 30 located between the interior surface of the tube wall and the interior passageway of the tube.

The cooling jacket surrounds the interior passageway of the tube. The cooling jacket has a liquid coolant inflow 32 and a coolant vapor outflow 34. The feed end of the tube has an inflow funnel 36 and an inflow funnel passageway 38. The inflow funnel passageway connects the inflow funnel with the interior of the tube.

The mid-section of the intake component tube has a cryogen inflow passageway 40, which communicates with the hollow interior passageway of the tube. The cryogen inflow has a metal dispersion element 42. The metal dispersion element receives liquid coolant, such as liquid nitrogen, and disperses the liquid in all directions within the tube, providing for a more consistent and evenly distributed coolant within the interior of the tube.

The first feed end of the tube has a first end plug 44 with a first bearing seat 46. The second output end of the tube has a second end plug 48 with a second bearing seat 50. The second output end of the intake component tube has an output funnel 52.

There is an auger 54. The auger has a first feed end 56 and a second output end 58. The first feed end of the auger has a first shaft 60 with an associated first bearing 62. The second output end of the auger has a shaft 64 with an associated second bearing 66. The auger is located within the interior passageway of the hollow tube. The first feed end first bearing is received by and mated with the first bearing seat of the first end plug of the intake component. The second output end second bearing is received by and mated with the second bearing seat of the second end plug. The auger has an associated variable speed drive motor 68 which rotates the auger within the intake component. The drive motor may be a direct drive, meaning the shaft of the motor is joined with the auger, or the drive motor may be indirect, using a chain or external gear drive to rotate the auger. The variation of the speed of the auger drive motor allows for the increasing or decreasing the amount of time a substance to be milled is contained within the intake component. Substances to be milled with rapidly cool may be process through the intake component in a shorter time than substances which have a slower cooling rate, and require more time to reach maximum lowest temperature within the intake component.

There is a cooling source 70. The cooling source comprises a liquid coolant. The cooling source has an associated coolant pathway 72. The coolant pathway has a generally round tubular hollow configuration. The coolant pathway connects the coolant source to the cryomill system, thereby transferring liquid coolant from the cooling source to the cryomill system.

The cooling source may be either a gas or a liquid. Cooling sources are elected from the group of cooling sources, also referred to as coolants. The group of cooling sources includes nitrogen and argon and liquefied carbon dioxide and liquified air and liquefied halogenated hydrocarbon and liquefied nitrous oxide and liquefied nitric oxide and liquefied noble gases, such as helium.

The cooling source is operationally coupled by the coolant pathway to the intake component. The coolant pathway has a tank source line 74. The tank source line divides into a phase separator inflow line 76, having an inline valve 78, and a jacketing coolant reservoir inflow line 80, having an inline valve 82. The phase separator line is coupled to a phase separator 84. The phase separator has an outflow line 86. The phase separator outflow line divides into an intake component coolant line 88 and a cryomill coolant line 90. The intake component coolant line is coupled to the intake component, and the cryomill coolant line is coupled to the lid of the cryomill. The jacketing coolant reservoir inflow line couples the cooling source to the cryomill jacketing coolant reservoir.

There is a cryomill containment portion 92. The cryomill containment portion comprises an open top 94, a wall 96, and a base 98. The cryomill containment portion wall has an interior surface 100 and an exterior surface 102, with a wall thickness 104 there between. The wall thickness has a coolant passageway 106 therein, for allowing the passage of coolant within the thickness of the containment portion wall. The coolant passageway of the containment portion wall have an inflow pipe 108 and an outflow pipe 110. The interior surface of the cryomill containment portion forms a containment portion interior 112. The interior of the cryomill containment portion has an associated mixer 114. The mixer has a central vertical shaft 116 and a plurality of horizontally extensions 120. The mixer has an upper drive end 122 and a lower terminal end 124. The upper drive end of the mixer has an associated drive motor 128. The drive motor may be a direct drive, meaning the shaft of the motor is joined with the upper drive end of the mixer, or the drive motor may be indirect, using a chain, belt(s) or external gear(s) drive to rotate the mixer.

The cryomill containment portion base has a centrally located outflow aperture 126.

There is a cryomill lid 130. The cryomill lid has an upper, outer surface 132 and lower, inner surface 134. The lid has a centrally located shaft aperture 136 there through. The lid has a coolant inflow stub 138 there through. The lid has a material inflow stub 140 there through. The lid has a pair of thermocouple insert ports 142 there through. The thermocouple, or temperature sensor, insert ports allows for the placement of a pair of thermosensors 143 within the cryomill containment portion. The temperature sensors are located at two different depths within the cryomill containment portion, being an upper depth sensor and a lower depth sensor, so as to precisely control the volume of liquid cryogen used within the containment portion. The lower depth sensor has a first set point, and activates the liquid supply when the temperature goes above the first specified set point temperature. The lower sensor causes the opening of a coolant feed valve, allowing liquid coolant to flow into the containment portion. The upper depth sensor has a second set point which is a few degrees higher than the lower sensor. When the upper sensor reaches the second specified set point temperature, the control signal closes the coolant supply valve to the containment portion. The lid has a condensing plate inflow stub 144 there through. The lid has a condensing plate outflow stub 146 there through. The material inflow stub of the lid is operatively coupled to the output funnel of the second output end of the intake component tube. The cryomill lid coolant inflow stub is coupled to the cryomill coolant line of the coolant pathway. The lid has an exhaust port 148 there through.

In the preferred embodiment, the lid is continuous, and a single structure. In variations, the lid may be a pair of generally U-shaped structures, when joined together, form a lid with a hole through the center.

There is a cryomill lid condensing plate 150. The cryomill condensing plate has a generally hollow configuration, forming a fluid passageway 152 therein. The condensing plate has an inflow end stub 154 being continuous with the condensing plate passageway. The condensing plate has an outflow end stub 156 being continuous with the condensing plate passageway. The condensing plate has a centrally located shaft aperture 158 there through. The condensing plate has a material inflow stub aperture 160 through the condensing plate. The condensing plate has a pair of thermocouple insert stubs 162 forming apertures through the condensing plate. The condensing plate has a coolant inflow stub 164 forming an aperture through the condensing plate. The condensing plate is located between the lid of the cryomill and the cryomill containment portion. In the preferred embodiment, the condensing plate is a generally circular, generally flattened structure with a shaft hole there through. In a variation the condensing plate may have a generally U-shape with the mixing shaft passing through the U of the plate.

In the preferred embodiment a second coolant, such as liquid helium, is used to cool the condensing plate. The difference in the evaporation temperature makes the condensing plate more efficient when condensing liquid nitrogen coolant and returning the condensed liquid nitrogen back to the cryomill slurry. The use of a helium secondary coolant requires a second coolant source and a secondary coolant compression and delivery system.

There is a collection canister 166. In operation, the collection canister is located vertically beneath the cryomill containment portion. The collection canister has a lid 168 and a containment portion 170. The collection canister containment portion has an open top 172, a side wall 174, and a base 176. The lid of the collection canister has a poppet valve aperture 178 there through.

There is a gas shielded poppet valve subassembly 180. The gas shielded poppet valve subassembly has a lower end 182 comprising a body 184, and an upper end 186 comprising a valve seat 188 and valve 190. The upper end of the gas shielded poppet valve subassembly is operatively coupled to the base of the cryomill. The valve seat of the gas shielded poppet valve subassembly has a flange 192. The valve seat has an inner retention ring 194. The valve seat has a pair of threaded control bolt apertures 196 therein. The valve seat flange has a plurality of mounting bolt holes 198 there through. The valve seat has a inert gas line 200 coupled thereto. The inert gas line communicates with the valve seat through a seat inert gas passageway 202. The inert gas line comprises at least one outlet 203 which is located in the area round the valve itself. This outlet allows the passage of a protective inert gas to shield the valve, preventing freeze up from moisture, and excluding water and oxygen, which may cause a flammable substance to combust or explode.

The poppet valve body is located below the valve seat, when the gas shielded poppet valve subassembly is in an operational position. The valve body has four set screw apertures 204 there through with associated valve body bolts 206. The valve body has a pair of sloped slots 208 there through.

The valve body has an associated valve stem 210 has a valve end 212 and a control end 214, with a poppet being operatively coupled to the valve end of the valve stem. The valve stem is coupled to the valve body with the valve body bolts, thereby fixing the valve stem to the valve body.

The valve seat is coupled to the valve body by a pair of control bolts 216. The control bolts pass through the sloped slots of the valve body and are each threadedly received by the control bolt threaded holes in the valve seat. The control bolts allow the valve body to be rotated relative to the valve seat, thereby allowing the poppet valve to be in one of the group of orientations, the group of orientations including an open orientation and a closed orientation.

The valve body has at least one operational arm for facilitating the rotation of the valve body by a mechanical device, such as a motor or actuator.

There is a milling jacket coolant reservoir 218. The milling jacket coolant reservoir has a generally hollow cylindrical configuration with a top 220, a bottom 222, and a sidewall 224 there between. The milling jacket coolant reservoir side wall has an exterior surface 226 and an interior surface 228, with the interior surface forming an interior 230 of the milling jacket coolant reservoir.

The milling jacket coolant reservoir has an inflow 232 and an outflow 234. In the preferred embodiment, the interior of the side wall of the milling jacket coolant reservoir has a cooling coil 236 associated therewith and located therein. The cooling coil has an inflow end 238 and an outflow end 240. In the preferred embodiment, the inflow end of the cooling coil is coupled to the outflow (exhaust) of the milling jacket coolant reservoir. In this way the exhausted coolant from the milling jacket coolant reservoir helps to remove heat from the jacket which arises from the atmosphere.

In a variation, the inflow end of the cooling coil may be coupled to the coolant source, and have an associated valve 242 to control the flow of coolant through the coil. In this variation the inflow end of the cooling coil is coupled to the coolant pathway.

The outflow end of the cooling coil is operatively coupled to a coolant scavenging system 252.

The inflow of the milling jacket coolant reservoir is operatively coupled to the outflow of the containment portion of the cryomill. The outflow of the milling jacket coolant reservoir is operatively coupled to the inflow the cooling coil. The cooling coil acts to remove atmospheric heat from the wall of the milling jacket coolant reservoir.

In the preferred embodiment, this is done with the exhausted vapors from the milling jacket coolant reservoir. Fresh coolant may be fed into the milling jacket coolant reservoir from the coolant source through the coolant feed line 246. Coolant vapors are passed from the top exhaust line 248 into the cooling coil, and then to the scavenging system. In the preferred embodiment, the coil within the milling jacket coolant reservoir may be supplied with a coolant from the coolant source, or a second coolant source so as to more effectively lower the temperature of the first coolant which is used in the containment portion, and the milling jacket coolant reservoir, so as to enhance the condensation of the first coolant and return it to the cryomill containment portion and the slurry, as a liquid.

When helium is used as a second coolant, there is a secondary coolant source 71, being a helium tank, and a secondary coolant delivery pipe 75 to supply the coil with the liquid helium and a return pipe 77, in a closed loop configuration 79. The secondary coolant source and delivery system are configured like the nitrogen cooling source and delivery system, having valves and piping to transport the secondary coolant. When helium is used as a secondary coolant, the helium is recompressed in a closed loop system, which, when evaporated in the condenser coil, is much colder than liquid nitrogen or liquid argon. In the same manner, when helium is used as a second coolant, the condensing plate located in the lid of the containment portion is in a closed loop helium delivery and return configuration.

There is an electrical power source with an electronic control 250. The electrical power source with an electronic control is operatively coupled to the valves of the coolant pathway. The electrical power source with an electronic control is operatively coupled to, and controls, the auger drive motor. The electrical power source provides the mixer drive motor with power. The mixer drive motor is independently controlled. The electrical power source with an electronic control is coupled to each of the valves for controlling the flow of coolant through the system.

Lastly, there is the coolant scavenging subsystem 252. The coolant scavenging subsystem has an intake 254 and storage tank 256. The coolant scavenging subsystem intake is coupled to the lid of the containment portion and to the outflow of the outrigger jacketing coolant reservoir. The coolant scavenging subsystem outflow feeds back into the cryomilling system, providing a recycling of cryogen, or coolant.

Cryomilling of various substances is generally carried out in an academic facility, where amounts of cryomilled substances are done in small batches. Such academic systems are not structured to function economically, but rather such systems use large amounts of coolant, with vaporized coolant being exhausted to the atmosphere, making the process costly. Such systems are configured to produce small volumes of nanograined, and nanosized material wherein concerns for combustion and explosion are minimized.

The present system is made to allow efficient and economical cryomilling of materials on an industrial scale, and is configured to reduce risk of fire or explosion, as well as reduce overall costs of cryomilling substantial volumes of flammable and combustible material, such as aluminum, magnesium and titanium.

Further, the present system provides a system and a method of cryogenically milling powders with invented hardware and methodology allowing industrial scale cryomilling with minimal gross liquid nitrogen consumption which otherwise would be very difficult to logistically deliver to the milling site.

The present invention pertains to a system for fine grinding of aluminum powder (and other flammable/combustible metal powders) utilizing an attritor ball grinding mill modified for cryogenic liquid, which is used to embrittle and grind flammable and/or combustible metal powder to produce nanostructured material.

In operation an attritor ball mill, such as a Union Process (Akron, Ohio) or equivalent system, is modified in accordance with the present invention. Powder material to be cryomilled is introduced to the mill using an auger powder feeding system, referred to as the intake component, which allows cooling of dry powder and subsequent mixing with cryogenic liquid to form a slurry before the feeding of the cooled slurry into the mill.

The cryomill containment portion of the system utilizes a modified attritor which has been modified so as to increase the length of the shaft as well as the number of horizontal extensions which enable the grinding of aluminum powder, as well as other flammable and combustible metal powders with a safe slurry level above the top arm of the attritor.

In operation, the aluminum powder to be cryomilled enters the containment portion, also referred to as the "mill", and comes in direct contact with magnetic stainless steel grinding balls. The grinding balls may be made of 400 series stainless steel, or other hard materials such as tungsten carbide, cobalt, or silicon carbide. In the preferred embodiment the balls are approximately one forth of an inch in diameter. In variations of the embodiment balls having a diameter of three sixteenths of an inch, three eighths of an inch, and one half of an inch may be used.

The mixer, or attritor, churns the balls, and the balls motion grinds the powder between the contact points of the balls, to a very fine grain size. A Standard ball-to-powder ratio of about 30:1 (For a laboratory scale mill (e.g., modified Union Process, 1-mill), may be used. The mill grinding arm rotates at approximately 180 revolutions per minute (rpm), though faster or slower speeds may also be employed in that the turning rate may be determined by the type of material being milled and the desired effects to the material being milled, as well as other variables, such as ball to powder ratio, ball size and material, mixing arm size and material, containment portion size and material.

For every one (1) kilogram of aluminum powder to be processed, thirty (30) kilograms of steel balls are needed as grinding media, per run. Contamination may result from the grinding media. This can be magnetically separated by using balls made of magnetic stainless steel to reduce the contamination from the grinding media.

The aluminum powder's microstructures are reduced to submicron, near-nano and nano-scale in size using this process. Particle size is also manipulated by this process, and the particle size can be reduced or increased independently of the microstructure by the control of parameters such as starting material type, milling speed, ball to powder ratio, and the addition of process control agents to the cryogenic slurry. In operation, a cryogenic liquid supply system introduces liquid cryogen into the ball mill. The cooling of the milling system usually takes several hours (e.g., 2 hrs.), before the powder is introduced to the cooled mill. This time is based on the size of the mill, the amount an type of media, and how aggressively the operator carries out the cooling process. The temperature at the start of the milling process is minus one hundred ninety six degrees centigrade (−196° C.) for liquid nitrogen.

The powder which enters the mill, after mill cool down, is provided in a slurry form during a two-step operation. The powder is precooled in the first step, and then mixed with cryogenic liquid in the powder feeding system the intake component, in a second step before entering the mill.

The milling process requires approximately 1200 ml of cryogenic liquid to be mixed with one (1) kilogram of aluminum powder to form the slurry. This ratio will vary with different alloys densities and milling hardware sizes. After feeding this slurry to the mill, cryogenic liquid is continually metered and delivered to the mill as needed. The coolant is used to embrittle the metal powder, and to cool the heating generated during the milling. The coolant maintains the mill at a predetermined low temperature.

The cryogenic liquid may include nitrogen, argon, carbon dioxide and others. Nitrogen is the primary liquid used in the preferred embodiment In academic settings, where small amounts of aluminum powder is milled, 184 gallons of liquid cryogen (nitrogen) are used in an eight (8) hour milling run to grind one (1) kilogram of aluminum powder. Thirty (30) kilograms of steel balls are used in the academic process to grind the one (1) kilogram of aluminum powder. In the preferred embodiment process, larger attritors are used. In the preferred embodiment process, fifty (50) kilograms of cryomilled aluminum powder will be milled, with the usage of nine thousand, two hundred (9,200) gallons of liquid nitrogen being consumed in an eight (8) hour run, utilizing one thousand, five hundred (1,500) kilograms of grinding balls. The volumes of coolant used for such a process makes the costs of large industrial milling cost inefficient. The present, preferred embodiment, utilizing a scavenging system, makes large scale milling possible and cost effective.

The prior art teaches various techniques utilizing liquid nitrogen in combination with a grinding mill to effect the grinding of resilient or soft materials, including polymers. U.S. Pat. Nos. 2,609,150, 2,735,624, 2,919,862, 3,614,001, 3,771,729 and 3,273,294 illustrate the use of a liquid cryogen (e.g., liquid nitrogen) to pre-cool the grinding mill and materials to achieve a ground product. Various refrigerants may be used to cool a material well below its embrittlement temperature, and thereby comminute the material at low temperatures. However, previous attritor mills designs that use cryogenic liquids are primarily based on resilient or soft materials such as plastics, and do not contemplate flammable or combustible materials on an industrial scale.

Liquid Cryogen Control System

A temperature sensing system with thermocouples is used. The thermocouples are positioned in the powder precooling feeding (conveyance) station, grinding mill, and milling jacket coolant reservoir, for monitoring the temperature of the powder being precooled and ground in the apparatus.

The liquid cryogen control system differs from that which is commonly used to produce small quantities of processed material by the present invention utilizing two sensors which are located within the grinding chamber/tank, referred to as the containment portion of the cryomill. The sensors are thermocouples in a temperature control system controlling the valves in the liquid cryogen supply system. The sensors are spaced at two different depths in the grinding tank to precisely control the volume of liquid cryogen used in the grinding tank. The lower sensor activates the liquid supply when the temperature goes above a specified temperature. This sensor opens the valve allowing liquid cryogen to enter the tank. The upper sensor is located higher (at less depth) in the grinding tank. When the upper sensor hits a specified temperature, a control signal activates the liquid supply valve to close.

The basic milling designs, that have been used for polymers, were later used for metals with little further design changes to handle a particular metal's unique characteristics. Further, little additional efforts were done to "harden up" the mill for use with flammable and/or combustible metal powders. Also, several of the methods and apparatus for using cryogenic liquids in milling of polymers are differentiated in that the cryogenic liquid was separated from the polymer by a barrier or wall. Thus, the polymer was embrittled by heat transfer mechanisms across a barrier/wall, and polymer was not in direct contact with the liquid. The method of cryomilling in this application has the liquid coolant in intimate contact with the metal powders.

In addition to the considerable technical details to enable the manufacturing of nanostructured metallic powder, safety considerations present a tremendous challenge. The herein described apparatus, and method, for the milling of aluminum (and other flammable and/or combustible metals), places the milling procedure in an entirely different category from that of the cryomilling of polymers, or even other metal alloy powders.

The characteristics of aluminum powder, and the hazard potential, are critical in the design of the milling apparatus. Aluminum powder is combustible and classified as being flammable. Mixtures of aluminum powder and air are ignitable over a wide range of concentrations and can cause violent dust explosions or fires during the milling process, as many of such past events have been reported in the industry. Highly flammable hydrogen can also form on contact with water or other chemicals and present an additional risk of explosion. Such an explosion may lead to a secondary dust explosion. While the details for cryomilling of titanium and magnesium (other metal powders in the category of flammable and/or combustible) are not described in detail in this patent application, this apparatus has been designed for the cryomilling of these materials, as well as the cryomilling of aluminum.

The present described method and apparatus pertains to a method and apparatus for fine grinding (approximately 80 mesh and smaller) of aluminum powders (and other flammable and/or combustible metal powders) utilizing an attritor ball grinding mill modified for liquid cryogenic milling to embrittle ductile aluminum powder. It is anticipated that the mesh sized produced is related to the production parameters, such as ball size, and duration of grinding, and is variable.

In the herein described system and method, an attritor ball mill is utilized. The herein described attritor ball mill has been modified from a tradition mill in many features including powder pre-cooling and feeding system, grinding tank, grinding arm design and materials, vacuum/liquid jacketing, inert powder slurry transfer system (power removal from system) and gaseous inert shrouding.

The material to be cryomilled is introduced into the milling system using a specially designed powder feeding system as earlier described. The powder which enters the mill, after mill cool down, is provided in a slurry form during a two-step operation. The powder is precooled in the first step, and then mixed with cryogenic liquid in the powder feeding system in a second step before entering the mill.

The metal dispersion element causes the coolant, which is introduced into the intake component, to be mixed with the substance to be milled which is being transferred to the containment portion by the action of the auger. The formation of a slurry assures the most cooling of the substance to be milled.

The attritor subsection of the system, referred herein as the containment portion, utilizes a conventional attritor mill modified for cryogenic liquid use and grinding of aluminum (and other flammable and/or combustible) powder. In the preferred embodiment, the grinding bowl (containment portion) is approximately twice as large, in size and volume, than a conventional grinding bowl used in commonly carried out grinding processes. The preferred embodiment allows a doubling of capacity. In the embodiment utilized by the Applicants, using a modified Union Process 1-S mill) this is achieved by lengthening the containment portion from approximately nine and three quarter (9¾) inches (found in commonly available grinding systems) to thirteen and one half (13½) inches. The attritor arm, or "mixer" as it is referred to in this application, has been lengthened to fully utilize the larger grinding tank (or containment portion). The modifications to the mill are specific to the mill and the volume of product per run. It is anticipated that as larger amounts of product per run are produced, the size of the mill may be increased, which, in turn, may require some modifications to the dimensions of other parts.

In the case of a laboratory version, such as a modified Union Process, 1-S mill, the attritor arm (mixer) has been lengthened from thirteen and one half (13½) inches to eighteen and three fourths (18¾) inches length, with number of horizontal extensions increasing from ten (10) to sixteen (16) in quantity for the mixer used in the preferred embodiment. The increase in the number of horizontal extensions allows the quantity of powder and grinding media to be more than doubled, with additional room at the top of the containment portion for further liquid nitrogen during cryomilling.

The materials used for the grinding tank, arm and media have also been changed from a non-magnetic grade of stainless (300 series, used in the prior art) to magnetic grade (400 series) stainless steel. The magnetization of the mixer and milling balls assist in reducing contamination, which may occur from particles of grinding media and bowl entering the material.

In the case of using a modified Union Process 1-S mill, a large milling motor (5 hp) is used in the design, over the conventional mill, to the enable larger quantities of metal powder to be processed as indicated above. The support frame, which holds the containment portion, has been lengthened in size to accommodate the increase sizing of containment portion and mixer.

In the preferred embodiment, one hundred and eighty four (184) gallons of liquid cryogen (nitrogen) is used in an eight (8) hour milling run to produce one (1) kilogram of aluminum powder. This represents a substantial savings, in that there is a significant decrease in the amount of lost nitrogen coolant. Thirty (30) kilograms of steel balls are used in this setup to grind the one (1) kilogram of aluminum powder.

Using the variation with helium as a second coolant source, it is anticipated that the amount of first coolant required would be greatly decreased. The employment of a closed loop second coolant, such as helium, would result in considerable savings in first coolant, with the closed loop recapturing most of the helium used. In the preferred embodiment, the cryogenic liquid would be recycled to the maximum extent possible.

A condenser plate, which is the evaporator side of the closed loop helium system, is located in the containment portion (the cryomill), between the lower container and the lid, in order condense gaseous nitrogen which evaporates during the milling process. Gaseous nitrogen, exiting the milling tank during cryomilling operations, is ducted into a nitrogen reclaim system (scavenging system). The gaseous Nitrogen will be converted back to liquid nitrogen and provided as part of the supply cryogen to the process.

In addition to the technical considerations for milling aluminum to achieve specific metallurgical properties, safety considerations necessitated considerable design changes of the cryogenic handling system to handle the hazardous potential of fine ground aluminum powder. Aluminum powder is combustible and classified as being flammable. Mixtures of aluminum powder and air are ignitable over a range of concentrations and can cause violent dust explosions, or fires, during milling, as a great many recorded events can confirm.

Prior art, which provides for fine grinding and pulverizing for size reduction have been of considerable interest and application for many years. Historically, the plastics industry started cryomilling applications for fine grinding of resilient or soft materials, including polymers in order to reduce particle sizing for materials not otherwise easily ground. Later, the rubber and plastics industry needed scrap and recycle material to be ground to a particle size finer than eighty (80) mesh in order to be mixed with virgin material for reuse. The art contains various methods to utilize liquid nitrogen in combination with a grinding mill to effect the grinding of normally resilient or soft materials. Prior art teaches the use of a liquid cryogen (liquid nitrogen) to pre-cool, and continue cooling, the grinding mill and polymer materials to achieve a ground product. The techniques were originally developed for polymers and later implemented for the comminuting of metals.

Cryomilling aluminum provides an economical method to produced submicron, near-nano and nano structured metal powder material. Currently there are few economical processes for fine grinding of light alloys (aluminum alloys) to produce nanostructured materials with certain desirable properties. In the past, several processes have been utilized (pulverizing, size reducing or comminuting) which incorporate a liquid cryogen such as liquid nitrogen in the process.

The prior art reference various techniques for utilizing liquid nitrogen in combination with a grinding mill. Conventional hammer mills and impact mills have utilized liquid nitrogen, as a coolant inside the mills, for cooling the powder before milling. Further, air-swept impact mills (fluid classification mills) have been utilized with nitrogen to cool and grind the material. Although a fine ground material was obtained, the economics of the process were unfavorable, due to excessive amounts of liquid Nitrogen required in several of these techniques.

Over the past decade, attrition ball milling was found to be more economical, because of the excessive amount of liquid nitrogen required in some of these other processes (e.g., impact, fluid classification). Attrition mills have been modified to use liquid nitrogen for the milling and powder pre-cooling, and such systems were found to be the most preferred method for fine grinding of malleable metal powders.

Several commercial cryogenic mills are available to the market. Two examples include Retsch, GmbH, of Haan, Germany, and Spex of Metuchen, N.J. The cryomill manufactured by Retsch, is an impact mill, and specifically designed for small laboratory samples up to 20 milliliters. Union Process (Akron, Ohio) also has a commercially available attrition grinding ball mill with a cryogenic liquid system added to their Union Process, 1-S, attritor model. This commercial system may be used for several conventional pure metals (zinc, copper, etc.) and metal alloys (Nickel based—Inconel, stainless steels, etc.) powders, but does not address the design changes of the present invention.

The present invention differentiates its cryogenic milling system in a great many features as described in this application. The mill has been modified from a tradition mill in features including a powder pre-cooling and feeding system, grinding tank, attritor arm, in-situ recondenser system, vacuum/liquid jacketing, inert powder slurry transfer system, and gaseous shielded valve, which increases safety when used in the cryomilling of flammable and/or combustible metal powders.

In the preferred embodiment, the powder material to be cryomilled is introduced to the mill using an auger, cooled powder feeding system. The powder entering the mill is provided in a slurry form during a two-step operation. The powder is first precooled in a dry state. It is then mixed with cryogenic liquid in the powder feeding system in a second step before entering the mill.

The containment portion (also referred to as the attritor) of the system utilizes a mixer to enable grinding of Aluminum (and other flammable and/or combustible) metal powders in the cryogenic milling process. The grinding tank (containment portion) has been designed to be larger in size and volume than the conventional grinding tanks, thereby allowing a greater volume of slurry to be processed, capable of using a doubled volume of grinding media. The materials of construction for the grinding tank, arm and media have also been changed from a non-magnetic grade of stainless (300 series) to magnetic grade (400 series).

As part of the cryogenic milling, the powder to be comminuted is introduced to the mill in several cooling stages before being injected into the mill (containment portion) for grinding. The powder is first pre-cooled by chilling dry powder within a powder feeder (auger feed system) having a cryogenic jacket. This initially reduces the temperature of the powder to that which is closer to the temperature of the liquid cryogen.

Alternatively, the powder may also be pre-cooled using vapor from evaporating liquid cryogen recycled during the cryogenic milling process. Such a variation of the preferred embodiment would entail the coupling of the tank of the scavenged nitrogen to the powder feeder (auger feed system), using a pipe and control valve.

After the pre-cooling of the powder in the jacketed powder feeder (auger feed system), the powder is then cooled in a second stage when it is introduced to direct contact with the liquid cryogen in the intake component (powder feeder (auger feed system)), having the auger delivery component. The powder is subsequently either showered with, or immersed in a bath of, liquefied cryogen prior to transporting to the mill via the intake component. Depending on the cryogen, the liquid temperature is between about minus eighty degrees Centigrade (−80° C.) and about minus two hundred degrees Centigrade (−200° C.). In the case of liquid nitrogen, the powder is immersed in liquid nitrogen or showered with a stream or droplets at minus one hundred and ninety six degrees Centigrade (−196° C.). The powder is maintained in the bath long enough to be cooled to the temperature of the bath and thereby converted into a semi-brittle or brittle state. The brittle material is subsequently conveyed to, and operated upon by, a comminuting device (e.g., grinding mill), referred to as the containment portion.

It has been shown that embrittlement is effected by maintaining the substance, or material, for a controlled period of time in intimate contact with the cooling agent. Liquid nitrogen and liquid air are listed as suitable agents. The prior art also teaches a method of pre-cooling the powder material to assist in embrittling the material before it is fed into the mill. Further, the described apparatus includes a mixer-conveyor wherein cryogenic liquid refrigerant is introduced into the mixer-conveyor to embrittle the material to be comminuted before the material is fed into the mill. Other prior art uses a fluid classification impact mill utilizing liquid cryogen to pre-cool the material to be ground, and recycles vaporized cryogen from the mill back into the mill as the medium for conveying material to be ground into the mill.

Other prior art teaches a system wherein powders to be milled are transported into a chamber with a screw conveyor. The conveyor is inclined upward at some angle and filled with cryogenic liquid so that the powder is exposed to the cryogenic liquid for pre-cooling. The speed of the screw conveyor is controlled so as to ensure a complete cooling of the material in its passage through the bath of liquefied gas and to the comminuting device. If only partial cooling is required, the desired low temperature can be attained by suitably regulating the time during which the material is in the liquefied gas bath and/or in the area between the liquefied gas bath and comminuting device. For pre-cooling, the powder particles are assumed to be exposed to liquefied gas vapors which are evolved from the liquefied bath which the powders are therein transported.

In the present invention, the powder is cooled in a sequence of steps and substantially reduces the amount of liquid cryogen by carefully controlled cooling of a material to, or only slightly below, its embrittlement temperature in a cooling zone. The material is first, fed into a liquid jacketed powder feeder (auger feed system) where the powder is cooled down in a dry state to near the liquid cryogen temperature through a liquid cryogen jacketing. This reduces thermal shock to the powder and associated "popping turbulence and rapid expansion of gas carrying fine metallic particles with it" in the cryogen added in the second step. The cryogen is then added to the powder and mixed via a stirrer, in the case of the preferred embodiment, an auger, to uniformly distribute the metal powder throughout the liquid for subsequent pouring of a slurry into the grinding mill (or containment portion). The temperature gradient between the surface and core portions of the metal particles is substantially reduced before the material is fed into the mill.

The cryogenic liquid chosen for the fine metal powder grinding is a critical part of the cryogenic milling process. It is important for many aspects including evaporation temperature, chemistry, handling and safety. Chemically, the choice of a coolant is as important as the choice of the metal to be processed, as the metal may react with the environment. Liquid nitrogen is inert, colorless, odorless, non-corrosive, nonflammable, and extremely cold. Nitrogen makes up the major portion of the atmosphere (78.03% by volume, 75.5% by weight). Nitrogen is inert and will not support combustion, however, it is not life supporting. Nitrogen is inert except when heated to very high temperatures where it combines with some of the more active metals, such as lithium and magnesium, to form nitrides. It will also combine with oxygen to form oxides of nitrogen and, when combined with hydrogen in the presence of catalysts, will form ammonia. In the case of pure aluminum, cryogenically milling in liquid nitrogen will result in an uptake of the nitrogen in the final product, potentially forming nitrides, as has been found to occur. Further, in the case of milling with titanium, another flammable or combustible metal, it is advisable not to use nitrogen. As a minimum, nitrogen can be found interstitially within the milled titanium powder. In the case of titanium, argon is often chosen as the cryogenic liquid. Liquid argon has a boiling point of minus three hundred, two, point six degrees Fahrenheit (−302.6° F.) which is minus one hundred, eighty five point nine degrees Centigrade (−185.9° C.). Liquid argon is tasteless, colorless, odorless, non-corrosive, nonflammable, and extremely cold. Belonging to the family of rare inert gases, argon is the most plentiful of the rare gases, making up approximately 1% of the earth's atmosphere. It is monatomic and extremely inert, forming no known chemical compounds. Special materials of construction are not required to prevent corrosion when using liquid argon. In special cases, wherein argon is used as the milling coolant, the efficiency of the milling process will be increased by using nitrogen as a secondary coolant within the jacket surrounding the containment portion (mill). The liquid nitrogen jacketing reduces the evaporation of the argon (the more expensive cryogen) and reduces the amount of argon needed for the process.

Cryogenic liquid is continually metered and delivered to the containment portion (mill) and used to embrittle the metal powder, cool the heating generated during the milling, and maintain the mill at a predetermined low temperature. The cryogen may include nitrogen and argon, as primary and secondary coolants, as discussed. Other coolant gasses, such as carbon dioxide, may also be used. The liquefied cryogenic, such as liquid nitrogen, may be conveyed through insulated transfer lines to an elongated spray header or other suitable liquid dispenser. A spray header (herein the metal dispersion element) may comprise an elongated pipe having discharge ports spaced along its length through which the cryogenic liquid refrigerant is injected into the powder feed system. A metal dispersion element may also be used within the containment portion, so as to shower the milled material and grinding balls with coolant.

Alternatively, separate injection nozzles may be spaced along the powder feed system so as to inject the cryogenic liquid into contact with the material.

The flow of coolant through the system is controlled by an electronic controller connected with temperature thermocouples. There are a number of valves which control the flow of coolant. Such control valves may be of the on-off type or modulating type. Such valves entail an actuator for controlling the opening and closing movements of the valve. Actuators are operatively coupled to the electronic control by electrical or pneumatic signal lines. The electronic control is operatively coupled to an indicator-controller, which is connected through a signal line to a temperature sensor, such as a thermocouple, which is preferably located in the mill, powder feed system, and milling jacket coolant reservoir. Thus, in the cryomill, a sensor detects the temperature of the milled powder and cryogen mixture, which is also an indication of the internal mill temperature. The indicator-controller actuates a controller valve to turn-on or turn-off the flow of refrigerant through main line so as to maintain the temperature of the comminuted material at liquid cryogen temperature while still maintaining optimum size reduction of the material.

In the preferred embodiment the control system has two temperature sensors located within the grinding chamber/tank, referred to as the containment portion. The sensors are thermocouples in a temperature control system controlling the valves in the liquid cryogen supply system. The sensors are spaced at two different depths in the grinding tank to precisely control the volume of liquid cryogen used in the grinding tank. The lower sensor activates the liquid supply when the temperature goes above a specified temperature. This sensor opens the valve allowing liquid cryogen to enter the tank. The upper sensor is located higher (at less depth) in the grinding tank, and has a set point a few degrees higher than the lower sensor. When the upper sensor hits a specified temperature, a control signal activates the liquid supply valve to close.

Prior art teaches both screw and vibratory conveyors. Screw and vibratory conveyors have been used to convey powder to a cryomill. Various types of conventional mixer-conveyors have been employed, including, for example, perforated screw conveyors or vibratory conveyors capable of agitating the particles and conveying them to the mill. Such conveyor have been provided in horizontal an inclined arrangements, and in a range of lengths (e.g., five (5) feet to ten (10) feet long). The rotational speed of mixer-conveyor can be varied (e.g., five (5) rpm to ten (10) rpm) resulting in a residence time of the powder in mixer-conveyor for several minutes. Powder is conveyed to the mill for grinding by means of a transition chute. The Cooling conveyor, referred to as the intake component, has an auger feed system as well as a conduit for admitting liquid cryogen to the intake component tube. The present application teaches a fluid conveyance with the liquid cryogen for both providing a means to pre-cooling the powder and a means to transport for the powder to the mill as a slurry. Conveyance ducting or suitable piping is used to transport a liquid slurry of cryogen and powder to the grinding mill.

The present invention will increase the efficiency of the milling process by milling metal powder in a vacuum and liquid jacketed milling vessel. As described above, the present invention uses vacuum and liquid jacketing in the case of cryomilling with a primary coolant in the grinding tank. Here, liquid primary coolant is utilized to assist in the efficiency of the system. The liquid coolant jacketing combined with the secondary coolant which is cycled through the condenser plate, reduces or eliminates the uncontrolled evaporation of the primary, or first, coolant, which may be a more expensive cryogen, and thus the amount of first coolant, needed for the process, is reduced. The present preferred embodiment teaches a grinding vessel that enables liquid cryogen to be circulated in a closed circuit through the wall of the grinding tank, with the mill jacket coolant reservoir and the cold plate, also referred to as the N/He cycle jacketing coolant reservoir, acting to recapture the coolant.

In addition to vacuum and liquid jacketing, the present invention uses considerable insulation throughout the cryomilling piping system. In order to reduce wasteful heat leak and consequent loss of refrigerant, the mill jacketing coolant reservoir, mill housing, and any exposed piping and valving is covered with a thermal insulation material such as sponge rubber, foamed polyurethane, or other well-known insulation materials.

In the preferred embodiment, a cooling coil and mill jacket coolant reservoir is used in conjunction with the containment portion (grinding vessel), in order to provide the cryogenic liquid in liquid state as long as possible and condense cold evaporated gases back into liquid form in the milling area. Additionally, liquid nitrogen or other economical cryogenic fluid is circulated in a cooling jacket at atmospheric pressure to prevent an equal or higher vapor point cryogenic fluid (e.g., liquid argon) from evaporating out of the main vessel during the milling process.

A condensing plate is located, between the containment portion (tank), and lid, in order to condense evaporated gaseous cryogen (Nitrogen or Argon) from escaping through the exhaust system, during the milling process. Liquid Helium (or other coolant, such as Liquid Nitrogen), used in the condensing plate with a closed system, assists in reducing the quantity of first, primary, cryogen used (such as Liquid Nitrogen or Liquid Argon, by reducing the amount of cryogen being exhausted from the mill.

The condensing plate uses a cold plate, stage or chuck, cryogen pump, cryogen, a temperature controller, sensors, and necessary tubing. A pump is used to pump liquid nitrogen or Helium from liquid storage through a cold stage, chuck, or plate, in contact with gaseous nitrogen. When helium is used as a second coolant, the helium is carried in a closed loop system, reducing overall usage of the second coolant. A pump is controlled by a temperature controller to maintain the set point of the cold plate. Commercially available cold plates are capable of cooling below minus one hundred, ninety degrees Centigrade (−190° C.)

The present preferred embodiment and method, is distinguished from University based methods in that the present invention will safely process larger amounts of flammable and combustible powders while greatly reducing the overall cryogen liquid wasted as exhausted vapor.

Lastly, the gas shielded poppet valve prevents freeze up of the poppet valve as well as shielding the valve and collection canister, which has an opening to the containment portion (mill), from moisture and oxygen, both which can cause a reaction resulting in combustion and/or explosion when milling flammable materials as well as cause detrimental effects to desired final products. The valve may be controlled and operate electronically, using a mechanical means, such as an actuator, or the valve may be manually opened and closed using an insulated rod, which is used to open and close the valve. The shielded valve has a inert gas inflow, which communicates with the valve seat, causing inert gas to shield the poppet.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cryomill system comprising, in combination:

an intake component comprising a hollow tube configuration having an interior passageway and a tube wall, the tube wall having an interior surface and an exterior surface, the hollow tube having a tube first feed end and a tube second output end with a mid-section there between;

an auger having a first end being the feed end and a second end being the output end, the auger first feed end having a first shaft with an associated first bearing, the auger second output end having a second shaft with a bearing, the auger being housed within the intake component;

a cooling source containing a liquid coolant, the cooling source having an associated coolant pathway, the coolant pathway having a tubular hollow configuration comprising a plurality of connected pipes, the coolant pathway connecting the coolant source to the cryomill system thereby transferring liquid coolant from the cooling source to the cryomill system;

a cryomill containment portion, the cryomill containment portion having an open top and a wall and a base, the cryomill containment portion wall having an interior surface and an exterior surface with a wall thickness there between, the cryomill containment portion being coupled to the intake component, the cryomill containment portion having a first upper temperature sensor and a second lower temperature sensor, with the first upper temperature sensor being located at a first depth in the cryomill containment portion and the second lower sensor being located at a second depth different from the first depth in the cryomill containment portion, the first upper temperature sensor and the second lower temperature sensor controlling the depth of the liquid coolant within the cryomill containment portion;

a cryomill lid having an upper, outer surface and a lower, inner surface, the cryomill lid being coupled to the cryomill containment portion;

a collection canister being located vertically beneath the cryomill containment portion, the collection canister having a lid and a containment portion, the collection canister containment portion having an open top and a side wall and a base, the lid of the collection canister having a poppet valve aperture there through; and a gas shielded poppet valve subassembly having a lower end comprising a body and an upper end comprising a poppet valve seat, the upper end of the gas shielded poppet valve subassembly being operatively coupled to the base of the cryomill, the gas shielded poppet valve having a gas inflow line, the gas inflow line of the gas shielded poppet valve being operatively coupled to the coolant source, the gas shielded poppet valve coupling the collection canister to the containment portion.

2. The cryomill system as described in claim 1, with the system further comprising the gas shielded poppet valve seat having a flange.

3. The cryomill system as described in claim 2, with the system further comprising:

a cryomill lid condensing plate having hollow configuration forming a condensing plate fluid passageway therein, the condensing plate having an inflow end stub being continuous with the condensing plate fluid passageway and the condensing plate having an outflow end stub being continuous with the condensing plate fluid passageway; and the poppet valve seat having an inner retention ring and the poppet valve seat having a pair of threaded control bolt apertures therein, the poppet valve seat flange having a plurality of mounting bolt holes there through.

4. The cryomill system as described in claim 3, with the system further comprising:

the intake component round hollow tube having a cooling jacket located between the interior surface of the tube wall and the interior passageway of the tube, the intake component first feed end of the tube having a first end plug with a first bearing seat, the second output end of the tube having a second end plug with a second bearing seat;

the cooling source being operationally coupled by the coolant pathway to the intake component, the coolant pathway having a tank source line;

the cryomill containment portion interior surface forming a containment portion interior with the interior of the cryomill containment portion having an associated mixer, the mixer having a central vertical shaft and a plurality of horizontally extensions, the mixer having an upper drive end and a lower terminal end, the cryomill containment portion base having a centrally located outflow aperture, the upper drive end of the mixer being operatively coupled to a mixer drive motor; and the poppet valve body having four set screw apertures theretherough, the valve body having a pair of sloped slots therethrough.

5. The cryomill system as described in claim 4, with the system further comprising:

the auger being located within the interior passageway of the hollow tube with the first feed end first bearing being received by and mated with the first bearing seat of the first end plug and the second output end second bearing being received by and mated with the second bearing seat of the second end plug, the auger having an associated drive motor;

the cryomill lid having a centrally located shaft aperture there through, the lid having a coolant inflow stub there through, the lid having a material inflow stub there through with the material inflow of the lid being operatively coupled to the output funnel of the second output end of the intake component tube, the cryomill lid coolant inflow stub being coupled to the cryomill coolant line of the coolant pathway; and the poppet valve stem having a valve end and a control end with a poppet being operatively coupled to the valve end of the valve stem, the valve stem being coupled to the valve body with a plurality of coupling bolts, the valve seat being coupled to the valve body by a pair of control bolts, the control bolts passing through the sloped slots of the valve body and being threadedly received by the control bolt threaded apertures in the valve seat, the control bolts allowing the valve body to be rotated relative to the valve seat, thereby allowing the poppet valve to be in one of the group of orientations which includes an open orientation and a closed orientation, the poppet valve body being located below the valve seat when in an operational position.

6. The cryomill system as described in claim 5, with the system further comprising:

the intake component cooling jacket surrounding the interior passageway of the tube, the cooling jacket having a liquid coolant inflow and a coolant vapor outflow;

the tank source line dividing into a phase separator inflow line having an inline valve and a milling jacket coolant reservoir inflow line having an inline valve, the phase separator line being coupled to a phase separator, with the phase separator having an outflow line;

the cryomill lid condensing plate having a centrally located shaft aperture there through; and the poppet valve body having at least one rotation arm coupled thereto.

7. The cryomill system as described in claim 6, with the system further comprising the intake component feed end of the tube having an inflow funnel and an inflow funnel passageway, the inflow funnel passageway connecting the inflow funnel with the interior of the tube.

8. The cryomill system as described in claim 7, with the system further comprising:

the phase separator outflow line dividing into an intake component coolant line and a cryomill coolant line, the intake component coolant line being coupled to the intake component and the cryomill coolant line being coupled to the lid of the cryomill, a cryomill jacketing coolant reservoir having an inflow line;

the cryomill lid having a pair of thermocouple insert ports therethrough, the lid having a condensing plate inflow stub therethrough and the lid having a condensing plate outflow stub therethrough; and the condensing plate having a material inflow stub which forms an aperture through the condensing plate, the condensing plate having a pair of thermocouple insert stubs forming apertures through the condensing plate, the condensing plate having a material inflow stub forming an aperture through the condensing plate, the condensing plate having a coolant inflow stub forming an aperture through the condensing plate.

9. The cryomill system as described in claim 8, with the system further comprising:

the mid-section of the intake component tube having a cryogen inflow passageway which communicates with the hollow interior passageway of the tube; and the cryomill lid having an exhaust port therethrough.

10. The cryomill system as described in claim 9, with the system further comprising:

the cryogen inflow of the intake component having a metal dispersion element; and the condensing plate being located between the lid of the cryomill and the cryomill containment portion.

11. The cryomill system as described in claim 10, with the system further comprising:

the second output end of the intake component tube having an output funnel; and the cryomill containment portion wall thickness having an outer vacuum insulation jacket and a plurality of coolant passageways therein for allowing the passage of coolant within the thickness of the containment portion wall, the coolant passageways of the containment portion wall having an inflow pipe and an outflow pipe.

12. The cryomill system as described in claim 11, with the system further comprising:

the mill jacket coolant reservoir having a hollow cylindrical configuration with a top and a bottom and a sidewall there between, the mill jacket coolant reservoir side wall having an exterior surface and an interior surface with the interior surface forming an interior of the mill jacket coolant reservoir, the mill jacket coolant reservoir having an inflow and an outflow, the interior of the side wall of the mill jacket coolant reservoir having a cooling coil located therein, the cooling coil having an inflow end and an outflow end, the outflow end of the cooling coil being operatively coupled to a coolant scavenging system; the coolant pathway having a plurality of valves;

an electronic control being operatively coupled to the valves of the coolant pathway, the electronic control being operatively coupled to and controlling the auger drive motor, the electronic control being operatively coupled and controlling to the mixer drive motor, the electronic control being coupled to each of the valves for controlling the flow of coolant; and a coolant scavenging subsystem, having an intake and storage tank, the coolant scavenging subsystem intake being coupled to the lid of the containment portion and the outflow of the coil of the outrigger jacketing coolant reservoir.

13. A cryomill system comprising, in combination:

a hollow tube intake component;

an auger housed within the hollow tube intake component;

a cooling source containing a liquid coolant being coupled to the cryomill system; by a plurality of connected pipes a cryomill containment portion, having a mixer located therein, the cryomill containment portion having a first upper temperature sensor and a second lower temperature sensor, with the first upper temperature sensor being located at a first depth in the cryomill containment portion and the second lower sensor being located at a second depth different from the first depth in the cryomill containment portion, the first upper temperature sensor and the second lower temperature sensor controlling the depth of the liquid coolant within the cryomill containment portion;

a cryomill lid being coupled to the cryomill containment portion;

a vertical collection canister having a poppet valve aperture there through; and a gas shielded poppet valve coupling the collection canister to the containment portion.

14. The cryomill system as described in claim 13, with the system further comprising:

a phase separator being coupled to the intake component and to the lid of the cryomill; and a condensing plate located within the cryomill containment portion.

15. The cryomill system as described in claim 14, with the system further comprising:

a mill jacket coolant reservoir being coupled to the cryomill containment portion;

an electronic control being operatively coupled to an auger drive motor and a mixer drive motor and to at least one valve for controlling the flow of coolant into the system; and a coolant scavenging subsystem.

* * * * *